United States Patent [19]

Blontrock

[11] Patent Number: 5,004,019

[45] Date of Patent: Apr. 2, 1991

[54] HARNESS FRAME WITH DETACHABLE CORNER CONNECTIONS

[75] Inventor: Daniel Blontrock, Roeselare, Belgium

[73] Assignee: N.V. Verbrugge, Roeselare, Belgium

[21] Appl. No.: 403,453

[22] Filed: Sep. 6, 1989

[30] Foreign Application Priority Data

Sep. 9, 1988 [BE] Belgium ..... 8801039

[51] Int. Cl.[5] ..... D03C 9/06

[52] U.S. Cl. ..... 139/91

[58] Field of Search ..... 139/91

[56] References Cited

U.S. PATENT DOCUMENTS

| | | | |
|---|---|---|---|
| 3,753,450 | 8/1973 | Koch | 139/91 |
| 4,307,757 | 12/1981 | Shimizu | 139/91 |
| 4,355,667 | 10/1982 | Shimizu | 139/91 |
| 4,883,095 | 11/1989 | Maruyama et al. | 139/91 |

FOREIGN PATENT DOCUMENTS

| | | | |
|---|---|---|---|
| 333679 | 12/1976 | Austria . | |
| 0003748 | 11/1982 | European Pat. Off. . | |
| 0008793 | 11/1982 | European Pat. Off. . | |
| 295189 | 12/1988 | European Pat. Off. . | |
| 3308371 | 5/1984 | Fed. Rep. of Germany . | |
| 2137643 | 12/1972 | France . | |
| 646468 | 11/1984 | Switzerland . | |
| 925562 | 5/1963 | United Kingdom | 139/91 |

*Primary Examiner*—Andrew M. Falik

*Attorney, Agent, or Firm*—Laubscher, Presta & Laubscher

[57] ABSTRACT

A harness frame for weaving machines includes a pair of horizontal vertically spaced upper and lower beams, and a pair of vertical cross beams (1) between which these horizontal beams (2) are mounted. A detachable connection is provided between each of the extremities of the beams (2) and the side of the cross beams (1) adjoining these extremities, including at least one screw (3,4) which extends in the extremity of the beams (2) through a connecting-piece (5) which is mounted in such a manner on this cross beam (1) that, on the one hand, substantially no stresses are transferred between the connecting-piece and the cross beams when tightening the screw (3,4) and when moving the harness frame and that, on the other hand, the beam (2) and the cross beam (1) are pulled towards each other by means of the connecting-piece (5). A solid connection is thus formed between the beam (2) and the cross beam (1) upon tightening of the screw (3).

18 Claims, 2 Drawing Sheets

HARNESS FRAME WITH DETACHABLE CORNER CONNECTIONS

BRIEF DESCRIPTION OF THE PRIOR ART

The invention relates to a harness frame for weaving machines comprising horizontal vertically-spaced upper and lower beams, and two upright cross beams between which said horizontal beams are mounted, wherein a detachable connection is provided between each of the extremities of the beams and the side of the cross beams adjoining these extremities.

The main object of the invention is to provide a harness frame of the above mentioned type in which stress concentrations are avoided as much as possible.

In case of most of the known harness frames, such stress concentrations occur in said cross beams when the latters are tightened against the extremity of the upper and under beams of the harness frame and also when the latter is driven and loaded by all kinds of forces, such as weaving forces, drive forces and gravity forces. Consequently, such stress concentrations cause very often an early breaking of harness frames.

SUMMARY OF THE INVENTION

The main object of the invention is to remedy these important drawbacks and this in an easy, technically and economically well-considered way.

To this end, the corner connections, between the cross beams and the upper and under beams, comprise each at least one screw which extends in the extremity of the beams through a connecting-piece which is mounted in such a manner on this cross beam, at said connection, opposite the extremity of the corresponding beam, that on the one hand, substantially no internal stresses are transferred between the connecting-piece and the cross beam when tightening the screw and when loading and/or moving the harness frame, and that, on the other hand, the beam and the cross beam are pulled towards each other by means of the connecting-piece and a substantially undeformable connection is thus formed between the beam and the cross beam when tightening the screw.

Suitably, the cross beams have at least in the part of the cross beams where the connection with the horizontal beams is realized, over the total length of this part, a substantially continuous course and substantially the same cross-section in order to avoid stress concentrations.

In a more particular embodiment of the invention, the part of the cross beams where the connection with the beams is realized, comprises three distinguished zones according to its crossdirection, a centrale zone, a guiding zone on the outer side of this central zone and an attachment zone on the inner side of the latter, whereby the guiding zone cooperates with a harness frame guide which extends sidewards on the outer side of the harness frame, the attachment zone has a U-shaped cross-section provided for fixing said connecting-piece and the central zone, wherein possible bending stresses are minimal, forms the transition between the two other zones.

The invention further relates to a harness frame comprising two beams, an upper and an under beam, and two upright cross beams between which the beams are mounted, wherein a detachable connection is provided between each of the extremities of the beams and the side of the cross beams adjoining these extremities.

This harness frame is characterized in that a corner piece is fixed to the extremities of these beams, between which a connection with the cross beams is to be provided, which corner piece comprises two plates which are fixed on both sides to the body of the beams, this corner piece forming a support for the connection with the cross beam.

BRIEF DESCRIPTION OF THE DRAWING

Other details and advantages of the invention will be shown in the following description of some specific embodiments of the harness frame according to the invention; this description is only given by way of example and does not limit the scope of the invention; the reference numerials used hereinafter relate to the annexed figures.

In these different figures, the same reference numerals relate to the same or analogous elements.

DETAILED DESCRIPTION

In general, the invention relates to a harness frame for a weaving machine, more particularly to a specific corner connection of a harness frame which allows to make a sectional harness frame the construction of which is so that substantially no stress concentrations arise in the constituent parts of this harness frame, more particularly in the cross beams and the contiguous upper and under beams when the latters are mutually coupled and also when the harness frame is driven and loaded during the working of the weaving machine of which this harness frame is a part.

A harness frame is thus formed of two horizontal vertically-spaced beams, an upper and a lower beam, and two upright cross beams between which these horizontal beams are mounted.

More specifically, this is a harness frame of which the extremities of the beams and the side of the cross beams adjoining these extremities are connected to each other by means of a detachable connection.

One of the important features of the harness frame according to the invention consists in that said detachable connection comprises a connecting-piece having a very special shape, which cooperates with the cross beam and which allows to connect the latter in such a manner to the beams that substantially each stress concentration at this connection is excluded, as well during the fixation of a cross beam to a corresponding extremity of a beam, as during the loading and moving of the harness frame in a weaving machine.

In the annexed figures, some concrete embodiments are shown of a harness frame which complies with these special conditions.

In FIGS. 1 to 4, the most important parts of a harness frame according to a first embodiment of the invention are illustrated.

Figure 1:
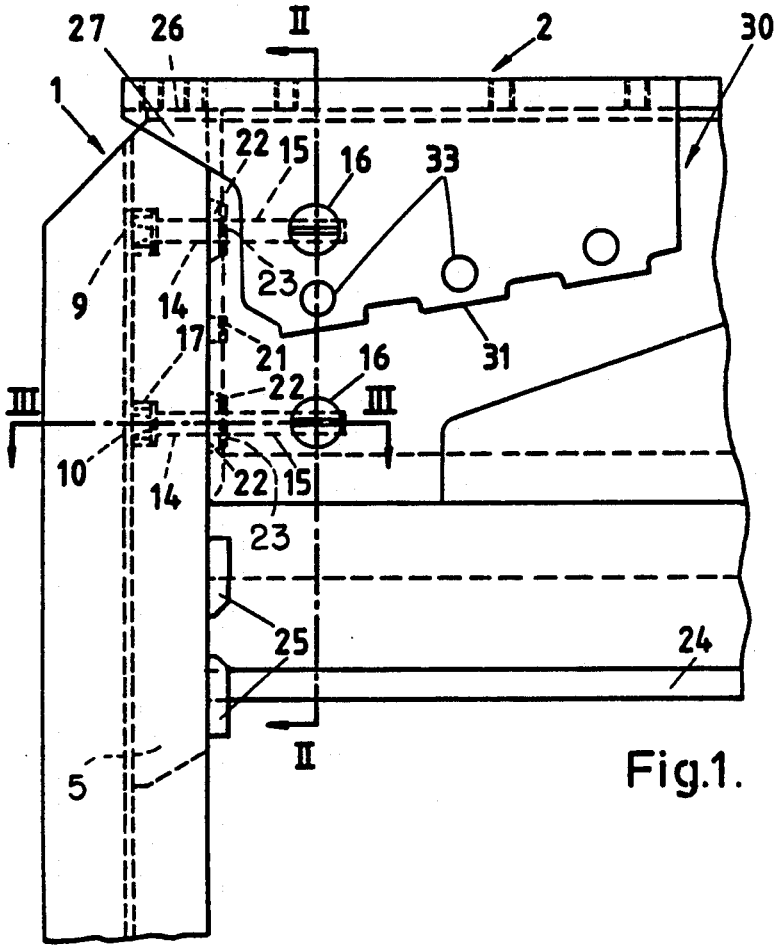
FIG. 1 is a partly sectional front view of a component of a harness frame according to a first embodiment of the invention.

In FIG. 1 which is a front view of the left, upper corner of this first embodiment, there is shown the upper extremity of the left vertical cross beam 1 with the corresponding extremity of the horizontal upper beam 2 being contiguous therewith.

This connection comprises two screws or bolts 3 and 4 which extend into the extremity of this upper beam 2, according to the longitudinal axis of the latter, through a connecting-piece 5 which is mounted in such a manner into this upper extremity of the cross beam 1 that, when tightening the screws 3 and 4, and when loading and/or moving the harness frame this cross beam 1 and this upper beam 2 are part of, there arise substantially no stress concentrations in the cross beam and in the beam in the vicinity of these screws, mainly thanks to the fact that the forces, which are transferred by the screws onto the connecting-piece 5, are substantially equally distributed over the entire length of the part of the cross beam which cooperates with this connecting-piece.

It is important to notice also that, by the fact that the connecting-piece 5 and the cross beam 1 constitute two different elements, even if they are glued together without play at their contact surfaces, for example little cracks, which arise possibly in the connecting-piece 5 due to relatively high stress concentrations, mostly around the screws 3 and 4, cannot progress over these contact surfaces into the cross beam 1. Since the screws 3 and 4 do not cooperate directly with the cross beam 1—as they extend freely through the holes 9 and 10—the stress exerted on these screws cannot be transferred directly to the cross beam 1. From this point of view, the connecting-piece 5 and the cross beam 1 are thus always mutually independent.

Further, when tightening the screws 3 and 4, the extremity of the beam 2, contiguous to the cross beam 1, and this cross beam are pulled towards each other via the connecting-piece 5 and a substantially undeformable coupling is formed between the beam 2 and the cross beam 1.

At least in the part of the cross beam 1 where the connection with the beam 2 is realized or even over its entire length, as it is the case in this first embodiment, this cross beam is having preferably a continuous course and the same cross section in order to avoid stress concentrations.

Figure 3:
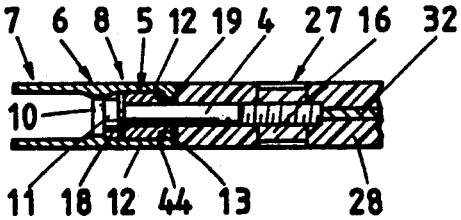
FIG. 3 is a cross section according to line III—III of FIG. 1.

More particularly, the cross beam 1 of this first embodiment comprises, according to its cross-direction, three distinguished zones, namely a central zone 6, a guiding zone 7 on the outer side of this central zone and an attachment zone 8 on the inner side of the latter, as clearly shown in FIG. 3.

The guiding zone 7 cooperates with a non-represented harness frame guide known per se, which extends sidewards on the outer side of the harness frame and which is mostly fixed to the weaving machine. p The attachment zone 8 is bifuricated to define a U-shaped cross section wherein the connecting-piece 5 is fastened.

The central zone 6 forms the transition between the two other zones 7 and 8 and determines the so-called neutral zone, i.e. the zone in which possibly bending stresses acting on the cross beam are minimal. Consequently, this zone 6 forms in principle the least loaded zone so that the risk of important stress concentrations in this zone is extremely minimal.

In this central zone 6 there are bored two holes 9 and 10 through which the head 11 of the bolts of screws 3 and 4 extends freely.

The free ends of the legs 12 of the bifricated U-shaped attachment zone 8 comprise a pair of up-standing hook shaped edges 13 directed inwardly according to a sharp angle against which the connecting-piece 5 is pressed by means of the screws 3 and 4. In the connecting-piece 5, there are provided cylindrically shaped borings 14 the diameter of which corresponds approximately to the one of the screws. When the connecting-piece 5 is placed into the right position in the attachment zone 8 of the cross beam 1, the holes 9 and 10 are then situated coaxially opposite the corresponding borings 15 in this connecting-piece. In this way, the screws 3 and 4 can extend via the holes 9 and 10, through this borings 14 into corresponding borings 15 in the adjoining extremity of the beam 2, which are also coaxially to the borings 14. These borings 15 each ends into an internally threaded insert 16 which forms thus a nut fixed into the beam.

By tightening the screws 3 and 4 in these inserts 16, the cross beam 1 and the beam 2 can thus be pulled firmly against each other so that thus a substantially undeformable connection is obtained.

The head 11 of the screws 3 and 4 is sunk in an enlargement or countersink 17 at the entry of the borings 14 in the connecting-piece 5.

In this enlargement, the head 11 rests upon an undeformable support ring 18 which allows to distribute the pressure forces, during the tightening of the screws, over an as large as possible support surface of the connecting-piece 5.

Thanks to the presence of the hook shaped, inwardly directed edges 13 of the legs 12 of the U-shaped attachment zone 8 of the cross beam 1, there is realized, during tightening the screws 3 and 4, a positive anchoring of the connecting-piece 5 with the cross beam 1 which causes that the legs 12 are pressed sidewards against the connecting-piece and that they can thus certainly not be opened.

This connecting-piece 5 comprises furthermore a forward projecting portion 19 which extends between the up-standing edges 13 themselves and which is thus clamped, during tightening the screws 3 and 4, between these edges.

The collars 44 of the connecting-piece 5 cooperating with the edges 13 are preferably bevelled in the same way as these edges 13, and this in order to assure a good contact with the latter, and to further stimulate said positive anchoring as this is also the case for the forwards projecting portion 19.

In this first specific embodiment of the harness frame according to the invention, a positioning member, formed by a forwardly projecting pin 20, is provided on the side of the connecting-piece 5 facing to the beam 2, which in pin 20 penetrates without play in a corresponding hole 21 in the extremity of the beam 2 and which enables to place the cross beam with the connecting-piece 5 mounted therein in the right position against the beam 2 before tightening the screws 3 and 4.

On both sides of each of the borings 14 in the connecting-piece 5, there are two forwardly projecting lips 22 which also penetrate in corresponding holes 23 (FIG. 1) in the extremity of the beam 2 and which can also serve as positioning element, in the same way as pin 20.

These holes 23 are somewhat conical whereas the lips 22, which have a certain elasticity, partly enclose the screws 3 and 4 so that when the lips 22 are brought into their corresponding holes 23, at the assembling of a cross beam 1 and a beam 2, the lips are pressed gradually more firmly against the screws 3 and 4 during the tightening of these screws due to the conical shape of these holes. In this way, a progressive blocking of the screws is thus obtained and there is prevented that the latters would untie during the working of the harness frame.

As it is the case with the known harness frames, the upper and lower horizontal beams of the harness frame according to the invention are provided with a heddle rod 24 extending on the inner side of the harness frame, parallel to the longitudinal direction of the beams.

According to the invention, the connecting-piece 5 comprises a heddle stop means 25 which is formed by two projections which are also provided on the side of the connecting-piece facing to the beams, opposite the extremities of the heddle rod 24. The projections enclose partly each of these extremities, as a result of which it is prevented that the non-represented heddles, which are pushed on the heddle rod 24, would fall off the latter during the working of the harness frame.

To fix the connecting-piece 5 into the U-shaped zone 8 of the cross beam 1, this connecting-piece 5, the cross section of which corresponds to the one of the space between the legs 12 of this zone, is pushed without play in the latter according to the longitudinal axis of the cross beam. On the extremity of the connecting-piece 5, an abutment 26 is provided which engages the corresponding free extremity of a cornerpiece 27 of the cross beam 1 on the moment that the connecting-piece 5 has reached its right place in the U-shaped attachment zone 8 during this pushing in.

The connecting-piece 5 is preferably glued into the attachment zone 8 as a result of which all possible play of the connecting-piece with respect to the cross beam 1 is avoided.

In a favorable manner, the connecting-piece 5 consists of a substantially rigid, vibration attenuating material. It has been determined that a sprayed synthetic material reinforced with fibres, such as polyamide with 25% glass fibre, allows to obtain very good results relating to attenuating, strength as well as to wear-resistance.

The cross beam 1 as well as the beam 2 may for example consist of aluminium or of a synthetic material reinforced with fibres.

In this first embodiment, the upper and lower horizontal beams 2 each have an I-shaped cross section. Since the upper and lower horizontal beams are of identical construction, only the upper beam has been illustrated in the drawings.

Figure 2:
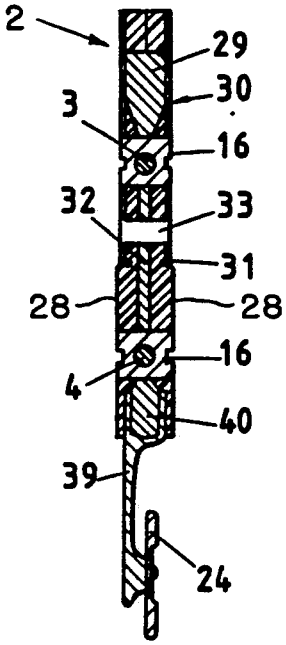
FIG. 2 is a cross section according to line II—II of FIG. 1.

On the extremities of each of these beams 2, between which the connection with the cross beam 1 is provided the aforementioned piece 27 is fixed end includes two plates 28 formed from a relatively hard plastic, which are fixed on both sides against the body 32 of the beam 2 as it appears clearly from FIG. 2.

This corner piece 27 constitutes thus a support for the connection with the cross beam.

The thickness of these plates 28 is such that they form, together with the broadened outer edge 29 of the I-shaped beam 2, a flat outer side against which metal traction plates 30 are mounted for the fixation of non-represented traction elements which are known per se and with which the harness frame is suspended into the loom. These plates 30 comprise a bent, preferably tooth shaped edge 31 which penetrates in the plastic plates 28 of the corner piece 27. Moreover, rivets 33 are provided which extend right through the traction plates 30, the plates 28 of synthetic material and the body 32 of the beam.

In a preferred embodiment of the invention, one of the plates 28 is provided, on the side facing to the body 32 of the beam 2, with one or more tenons 34 which extend through an opening 35 provided into this body 32 and these tenons 34 are fixed in a corresponding cavity 36 in the opposite plate 28. This specific embodiment is clearly illustrated in FIG. 10, in which an exploded view of a part of the beam 2 with the plates 28 is shown.

This tenon 34 is fixed without play into the cavity 36 by gluing and/or welding.

More particularly, the tenon 34 is provided with a forwardly projecting, annular welding rib 37 whereas the cavity 36 is surrounded by an upright collar 38 which penetrates into said opening 35 of the body 32 of the beam 2 and presses against this welding rib 37 with which a coupling without play is formed.

Figure 10:
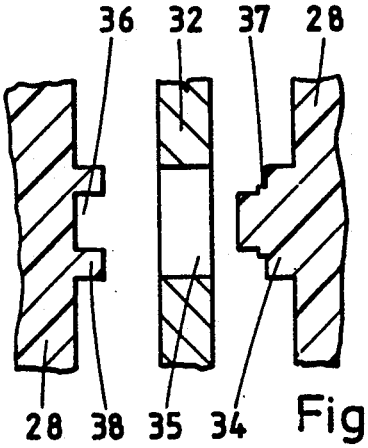
FIG. 10 shows, on a larger scale, a cross sectional, exploded view of a detail of a part of the component shown in FIG. 1 and FIG. 5.

By fixing the plates 28 on the beam 2 in the way shown in FIG. 10, the rivets 33 can possibly be dropped.

The heddle rod 24 is fixed to the beam 2 by means of an auxiliary profile 39. The heddle rod 24 is fixed to one of the longitudinal edges of this auxiliary profile, whereas the opposite edge is U-shaped and enclosed the broadened outer edge 40 of the I-shaped beam 2 and is covered by the plates 28.

Preferably, the side of the plates 28 facing to the beam is moreover glued over its entire surface against the beam.

In FIGS. 5 to 9, a second embodiment of the harness frame according to the invention is shown.

Figure 4:
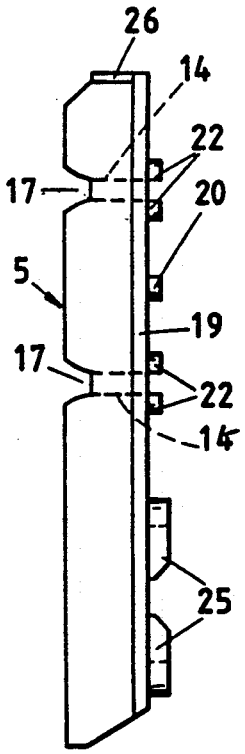
FIG. 4 is a side view of the connecting-piece shown in dashed line in FIG. 1.

This embodiment distinguishes itself with respect to the first embodiment according to FIGS. 1 and 4 mainly by the fact that the connecting-piece 5' is integral with the beam 2', more particularly with the plates 28' of the corner piece 27' which are fixed sidewards to the extremity of the I-shaped beam.

In this specific second embodiment, said plates 28' are connected to each other on two of their opposite side edges by means of a bridge 41 so as to form a cap which is pushed over the extremity of the beam 2'.

Figure 8:
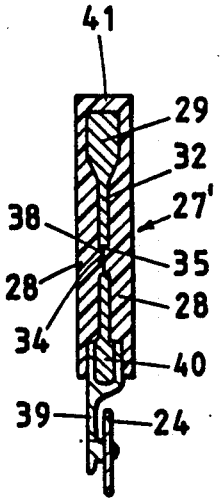
FIG. 8 is a section according to line VIII—VIII of FIG. 7.
Figure 9:
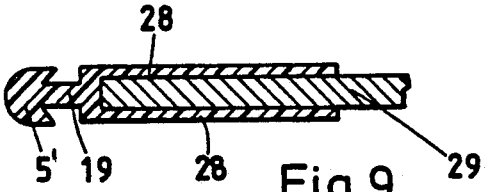
FIG. 9 is a section according to line IX—IX of FIG. 7.
Figure 6:
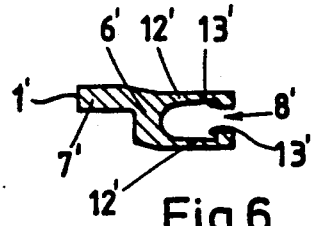
FIG. 6 is a section according to line VI—VI of FIG. 5.

The plates 28' are fixed to the beam in the way shown in FIG. 10 as appears clearly from FIG. 8.

Moreover, a resiliently compressible zone is provided between the connecting-piece 5' and the beam 2' as a result of which the connecting-piece 5' can be tightened without play in in the cross beam 1' when tightening the screws 3 and 4.

A groove 42 is provided at this resiliently compressible zone which groove extends crosswise to the axis of each screw 3 and 4 and which is consequently compressed when tightening the screws.

As it is the case with the first embodiment, the attachment zone 8 is U-shaped to define legs 12 provided with edges 13' directed inwardly at a sharp angle. Instead of a U-shaped guiding zone, as this is the case in the first embodiment, the zone 7' is formed in this second embodiment by a tooth guide which cooperates for example with a non-represented, U-shaped, fixed guide on the weaving machine on both sides of the harness frame.

Figure 5:
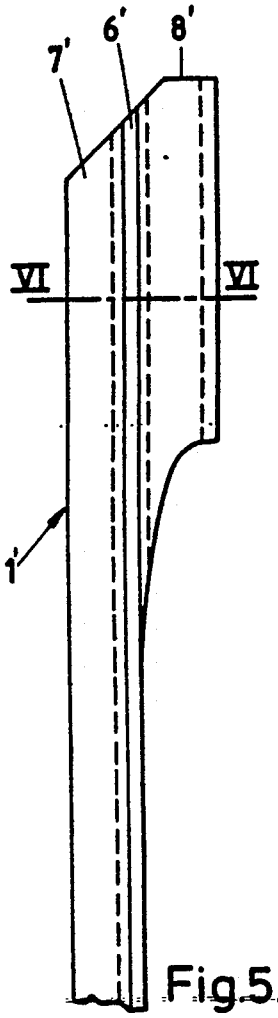
FIG. 5 is a front view of a part of a cross beam of the harness frame according to a second embodiment of the harness frame according to the invention.
Figure 7:
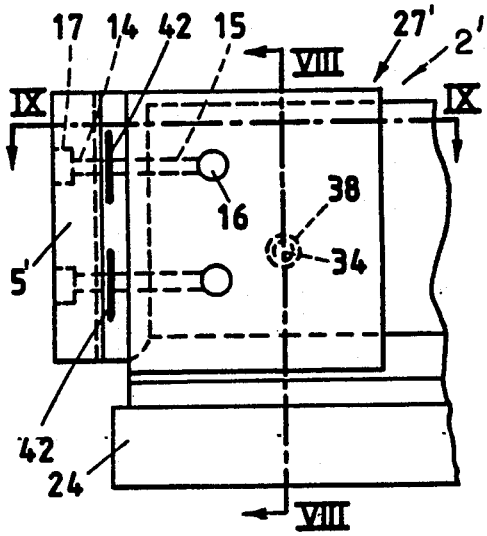
FIG. 7 is a partial front view of an extremity of a beam according to this second embodiment of the invention, having a connecting-piece mounted on its extremity.

Further, as appears from FIG. 5, the cross beam 1' changes, outside the critical zone, i.e. the part of the cross beam where the connection with the beams is formed, in a continuous manner into a narrower profile shape. This can for example be necessary to make the distance between the opposite cross beams in the harness frame as large as possible or also to realize a somewhat resiliently deformable harness frame. It is of utmost importance that this change of shape goes smoothly in order to avoid stress concentrations at the transition between the broad and the narrow profile shapes.

Figure 11:
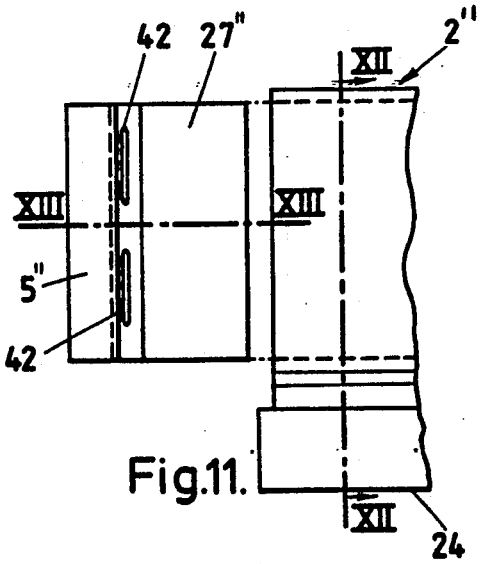
FIG. 11 is a frontal, also exploded view of the extremity of a beam, with a connecting-piece to be fixed onto this extremity, of a harness frame according to a third embodiment of the invention.
Figure 12:
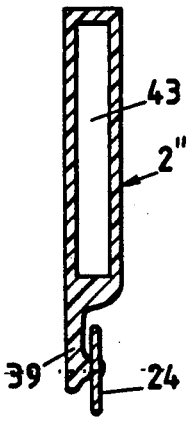
FIG. 12 is a cross section according to line XII—XII of FIG. 11.
Figure 13:
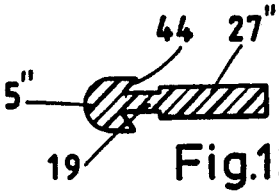
FIG. 13 is a cross section according to line XIII—XIII of FIG. 11.

In FIGS. 11 to 13, there is shown a third embodiment of the harness frame according to the invention.

This third embodiment is distinguished from the two previous ones mainly by the fact that use is made of a beam 2'' having a tubular profile as appears clearly from FIG. 12. In this embodiment, the corner piece 27'' is formed by a core which is glued without play into the hollow space 43 of the tubular beam 2''.

As appears from FIGS. 11 and 13, this corner piece is integral with the connecting-piece 5'', as it is the case with the second embodiment described hereabove.

Further, the auxiliary profile 39, which carries the heddle rod 24, forms a whole with this tubular profile.

The invention is of course in no way limited to the embodiments described above and shown in the FIGS. and many modifications can be taken into consideration within the scope of the invention amongst others relating to the shape, the relative dimensions and the choice of material of the constituent components.

In the second and third embodiments the corner pieces 27' and 27'' respectively can thus possibly be fixed to the beam by means of rivets. For example in the third embodiment, the corner piece 27'' can further be independant from the connecting-piece 5'' and the latter can consequently be fixed to the beam 2'' more particularly to the core inserted in the latter, in the same way as in the first embodiment.

Moreover, the bridge 41 between the plates 28' (FIG. 8) can be deleted in the second embodiment. If the different components of the harness frame to be fixed to each other are glued to each other, the assembly can be furthermore welded ultrasonically which offers the advantage that everything is connected without play to each other.

Further, the screws 3 and 4 can extend axially as well as somewhat obliquely with respect to the longitudinal axis of the beams 2.

What is claimed is:

1. A harness frame for weaving machines, comprising:

(a) a pair of spaced vertical beams (1);

(b) at least one horizontal beam (2) extending between said vertical beams, each of said vertical beams including in horizontal cross-section a central portion (6), an attachment portion (8) intermediate said central portion and the associated horizontal beam, and a guide portion (7) on the opposite side of said central portion from said attachment portion, said portions extending longitudinally of said vertical beam; and (c) means connecting the ends of said horizontal beam with the associated vertical beam, respectively, said vertical beam attachment portion being bifurcated to define a pair of leg portions (12) which terminate adjacent the associated end of said horizontal beam, the extremities of said leg portions including inwardly directed projections (13), respectively, said connecting means including:

(1) a connecting member (5) mounted between said leg portions and in engagement with the adjacent surfaces of said inwardly directed projections, and (2) at least one screw (3,4) having at one end an enlarged head portion (11) arranged in an opening (10) contained in said vertical beam central portion, said enlarged head portion being in engagement with the adjacent end of said connecting member, said screw extending at its other end through a bore contained in said connecting member and between said projections, said screw terminating in threaded engagement with said horizontal beam, whereby upon tightening said screw, said connecting member and said vertical beam are drawn into tight engagement with the associated end of said horizontal beam.

2. A harness frame as claimed in claim 1, wherein said connecting member is provided, at its side facing said horizontal beam, with at least one positioning member (20) arranged to cooperate with said horizontal beam to maintain the same in a given position with respect to said connecting member prior to the tightening of said screw.

3. A harness frame as claimed in claim 1 wherein said frame further comprises a heddle rod (24), and further wherein said connecting member is provided, on its side directed to said horizontal beam, with projecting heddle stop means for preventing heddles from falling off said heddle rod.

4. A harness frame as claimed in claim 1, wherein said connecting member consists of a substantially rigid vibration attenuating material.

5. A harness frame as claimed in claim 1 wherein an abutment (26) is provided on an extremity of said connecting member which cooperates with a corresponding free extremity of said cross beam.

6. A harness frame as claimed in claim 1, wherein said connecting member is adhesively secured to said cross beam.

7. A harness frame as claimed in claim 1, wherein said connecting member is carried by said horizontal beam.

8. A harness frame as claimed in claim 7, wherein said connecting member is connected with a corner piece which is mounted on an extremity of said horizontal beam.

9. Apparatus as defined in claim 1, wherein said connecting member includes a projecting portion (19) that extends between said inwardly directed leg projections.

10. A harness frame for weaving machines, comprising (a) a pair of spaced vertical beams (1);

(b) at least one horizontal beam (2) extending between said vertical beams, each of said vertical beams including in horizontal cross-section a central portion (6), an attachment portion (8) intermediate said central portion and the associated horizontal beam, and a guide portion (7) on the opposite side of said central portion from said attachment portion, said portions extending longitudinally of said vertical beam; and (c) means connecting the ends of said horizontal beam with the associated vertical beam, respectively, said vertical beam attachment portion being bifurcated to define a pair of leg portions (12) which terminate adjacent the associated end of said horizontal beam, the extremities of said leg portions including inwardly directed projections (13), respectively, said connecting means including:

(1) a connecting member (5) mounted between said leg portions and in engagement with the adjacent surfaces of said inwardly directed projections;

(2) screw means (3,4) connecting said connecting member with the associated end of the horizontal beam; and (3) a corner member (27) mounted on each end of said horizontal beam being integral with said connecting member and including a pair of plates (28) secured on opposite sides of said horizontal beam.

11. A harness frame as claimed in claim 10 wherein said plates are integral with said connecting member.

12. A harness frame as claimed in claim 10 wherein said plates have adjacent side edges connected to each other to form a cap which is mounted on one end of said horizontal beam.

13. A harness frame as claimed in claim 10 wherein the side of one of said plates adjacent said beam includes at least one tenon which extends through an opening provided with said beam and which is fixed in a corresponding cavity provided into said opposite plate.

14. A harness frame as claimed in claim 13, wherein said tenon is is secured within said cavity by gluing and/or welding.

15. A harness frame as claimed in claim 10, wherein a resiliently compressible zone is provided between said connecting member and said horizontal beam, whereby said connecting-piece can be tightened into said cross bam without play when tightening said screw.

16. A harness frame as claimed in claim 15, wherein said resiliently compressible zone contains on its outer surface at least one groove (42) that extends generally normal to the axis of said screw; said screw extending through said resiliently compressible zone and being threadably connected with the associated horizontal beam.

17. A harness frame as claimed in claim 10, wherein said plates of said corner piece are made of synthetic material, and further including traction plates mounted against the outer side of said plates of said corner piece, which traction plates have bent edge portions which penetrate into said plates of said corner piece.

18. A harness frame for weaving machines, comprising:

(a) a pair of spaced vertical beams (1);

(b) at least one horizontal beam (2) extending between said vertical beams, each of said vertical beams including in horizontal cross-section a central portion (6), an attachment portion (8) intermediate said central portion and the associated horizontal beam, and a guide portion (7) on the opposite side of said central portion from said attachment portion, said portions extending longitudinally of said vertical beam; and (c) means connecting the ends of said horizontal beam with the associated vertical beam, respectively, said vertical beam attachment portion being bifurcated to define a pair of leg portions (12) which terminate adjacent the associated end of said horizontal beam, the extremities of said leg portions including inwardly directed projections (13), respectively, said connecting means including:

(1) a connecting member (5″) mounted between said leg portions and in engagement with said projections; and (2) a corner member (27″) integral with said connecting member, said horizontal beam (2″) having a hollow tubular profile to define a chamber (43), said corner member including a core that extends within and is secured to the walls of said chamber.

* * * * *